US010472850B2

(12) United States Patent
Grace et al.

(10) Patent No.: US 10,472,850 B2
(45) Date of Patent: Nov. 12, 2019

(54) TRANSVERSE FOLDING SHADE

(71) Applicants: Daniel R. Grace, Old Saybrook, CT (US); Paul Titus Crotty, Waterford, CT (US); Bruce Agli, East Hampton, CT (US)

(72) Inventors: Daniel R. Grace, Old Saybrook, CT (US); Paul Titus Crotty, Waterford, CT (US); Bruce Agli, East Hampton, CT (US)

(73) Assignee: GCI Outdoor, Inc., Higganum, CT (US)

( * ) Notice: Subject to any disclaimer, the term of this patent is extended or adjusted under 35 U.S.C. 154(b) by 0 days.

(21) Appl. No.: 15/802,957

(22) Filed: Nov. 3, 2017

(65) Prior Publication Data

US 2018/0245368 A1 Aug. 30, 2018

Related U.S. Application Data

(60) Provisional application No. 62/417,038, filed on Nov. 3, 2016.

(51) Int. Cl.

| | |
|---|---|
| ***E04H 15/58*** | (2006.01) |
| ***E04H 15/48*** | (2006.01) |
| ***A47C 7/66*** | (2006.01) |
| ***A47C 4/28*** | (2006.01) |

(52) U.S. Cl.

CPC ..... *E04H 15/58* (2013.01); *A47C 4/286* (2013.01); *A47C 7/66* (2013.01); *E04H 15/48* (2013.01)

(58) Field of Classification Search

CPC ..... E04H 15/38; E04H 15/48; E04H 15/405; E04H 15/58; A47C 7/66

USPC ..... 135/133

See application file for complete search history.

(56) References Cited

U.S. PATENT DOCUMENTS

| | | | | | |
|---|---|---|---|---|---|
| 270,224 | A | * | 1/1883 | Johnson et al. | A47C 7/66 297/56 |
| 2,832,361 | A | * | 4/1958 | Smith | E04H 15/003 135/117 |
| 2,864,390 | A | * | 12/1958 | Oliver et al. | E04H 15/38 135/133 |
| 3,082,780 | A | * | 3/1963 | Macy | E04H 15/38 135/115 |
| 3,241,160 | A | | 3/1966 | Escobar | |
| 4,093,305 | A | * | 6/1978 | Staroste | A45B 23/00 297/184.17 |
| 4,915,120 | A | | 4/1990 | Ziolkowski | |

(Continued)

*Primary Examiner* — Noah Chandler Hawk

(74) *Attorney, Agent, or Firm* — McCormick, Paulding & Huber LLP

(57) ABSTRACT

A transverse folding shade includes a folding frame including a first hub, a second hub, a front assembly rotatably connected to the first hub and second hub, a rear assembly rotatably connected to the first hub and second hub, and a shade membrane connected to the front assembly and the rear assembly. The front assembly includes front support members, front arc members pivotally connected to the front support member via front support-arc pivots, the front arc members are pivotally connected to each other via a front arc-arc pivot. The rear assembly includes rear support members, rear arc members pivotally connected to the rear support members via rear support-arc pivots, the rear arc members are pivotally connected to each other via a rear arc-arc pivot.

12 Claims, 27 Drawing Sheets

(56) References Cited

U.S. PATENT DOCUMENTS

| | | | | | |
|---|---|---|---|---|---|
| 4,978,166 | A * | 12/1990 | James | A47C 7/66 297/184.13 |
| 5,515,564 | A | 5/1996 | Lyons | |
| D371,262 | S | 7/1996 | Forbes, Sr. | |
| D383,337 | S | 9/1997 | Lerner | |
| 5,695,100 | A * | 12/1997 | O'Brien | A47C 7/66 135/143 |
| 7,963,596 | B2 | 6/2011 | Efthimiou | |
| D725,424 | S | 3/2015 | Cohen | |
| 9,383,113 | B1 * | 7/2016 | Renwick | A47C 7/66 |
| 9,451,830 | B1 * | 9/2016 | Buzzella | A47C 7/66 |
| 2007/0102032 | A1 * | 5/2007 | Passaro Ponce De Leon | E04H 15/38 135/132 |
| 2014/0290710 | A1 * | 10/2014 | Choi | E04H 15/38 135/126 |
| 2016/0120323 | A1 * | 5/2016 | Rivera | A47C 1/143 297/184.15 |

* cited by examiner

TRANSVERSE FOLDING SHADE

CROSS-REFERENCE TO RELATED APPLICATIONS

This application claims priority to U.S. Provisional Patent Application No. 62/417,038, filed Nov. 3, 2016, which is hereby incorporated by reference in its entirety.

TECHNICAL FIELD

The present disclosure relates to folding shades, and in particular, folding shades for use in connection with portable and folding furniture, for example, lawn chairs, beach chairs, loungers military-style cots, and the like.

BACKGROUND OF THE INVENTION

Folding furniture, generally, is well known and has been used a long time. A general objective of folding furniture is ease of storage and portability, i.e., the furniture can be set-up for use and then folded down for transport and/or storage in a space of smaller volume than what the furniture occupies in its set-up condition. Additionally, it is desirable that such folding furniture can be folded to a compact size, and preferably in one-piece, for transport and storage, as the larger the space taken up or the more pieces to keep track of are not desirable features.

Shades are also generally known and have been used a long time. The general intent of shades is to provide cover from sun and/or rain for a user when outdoors. However, there exists a challenge to incorporate shades with folding furniture due to the shade's interference with the objective of keeping the ease of storage and portability of the folding furniture.

In view of the foregoing, there is a need for a collapsible shade for use with portable and collapsible articles of furniture that can be collapsed with the article of furniture in order to reduce the space occupied by the furniture in a folded condition, without complicating the collapsing of the article of furniture. Further, there is a need for such a collapsible shade for use with an article of furniture that can be folded with minimal effort, without limiting or compromising the structural features permitting use and set-up of the article of furniture and/or the shade. Further, there is a need for a collapsible shade that can be adjusted, as desired, without compromising the folding and transport or the shade and/or the article of furniture to which it is attached. Still further, there is a need for a collapsible shade that can be retrofitted for use with a variety of portable and collapsible articles of furniture, and which may be folded with the article of furniture without affecting its use or set-up. Accordingly, it is a general object of the present invention to provide a collapsible shade for use with foldable and portable articles of furniture that overcomes the problems and drawbacks associated with folding shades and folding furniture, and therefore significantly improves the utility of such furniture in the set-up condition while permitting easy transportation and/or storage in a collapsed condition.

SUMMARY OF THE INVENTION

The present invention is directed to a collapsible shade for use with collapsible and portable furniture, generally illustrated herein in connection with a collapsible and portable chair, especially suitable for use with articles such as a beach chair, a lawn chair, and the like, where the chair and the shade can be collectively folded from a set-up condition to a collapsed condition for transportation and/or storage.

In accordance with preferred embodiments of the present invention, the collapsible shade is attached to the chair and can be folded with the chair for transport and/or storage. The shade can be attached to a variety of folding chair designs, including but not limited to the conventional flat folding chair, the conventional X-Y folding chair, or Applicant's proprietary bi-fold chair design, as shown and described in Applicant's co-pending U.S. patent application Ser. No. 14/991,054, incorporated herein by reference.

In an aspect of the present invention, the shade can be secured at side hubs to the chair frame on the back rest or on the rear legs of the chair frame, and generally comprises two arcing members each having at least one hinge to aid in the collapsing of the shade. A flexible shade membrane or fabric materials extends between the arcing members. When the shade is in a set-up condition, the membrane is generally taut. The shade can be collapsed, and when so collapsed, the membrane is folded between the arcing members and ultimately folded within or adjacent to the chair frame members as the chair is collapsed. In preferred embodiments, the position of the shade over the head of a seated user sitting in the set-up chair can be adjusted via movement at the side hubs, and still more preferably, locked into certain positions once adjusted, as desired.

In alternate embodiments, a collapsible and adjustable shade is provided that can be retrofitted to portable and collapsible chairs and folded with said chairs.

These and other features of the present invention are described with reference to the drawings of preferred embodiments of a collapsible transverse folding shade for use with collapsible and portable articles of furniture. The illustrated embodiments of features of the present invention are intended to illustrate, but not limit the invention.

DETAILED DESCRIPTION OF EMBODIMENTS OF THE PRESENT INVENTION

Figure 1:
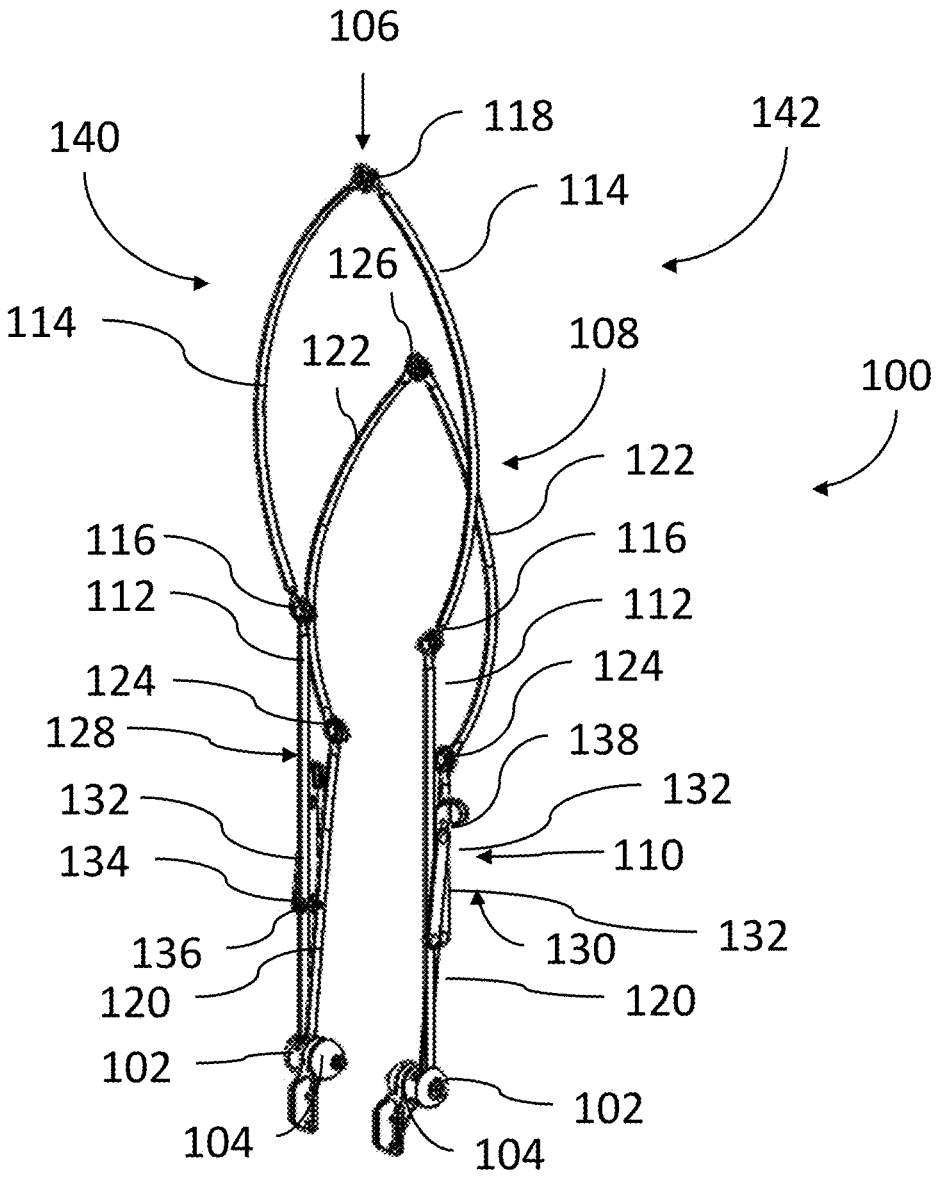
FIG. 1 shows a front, right perspective view of an exemplary transverse folding shade frame in a closed and folded position according to the present disclosure.
Figure 2:
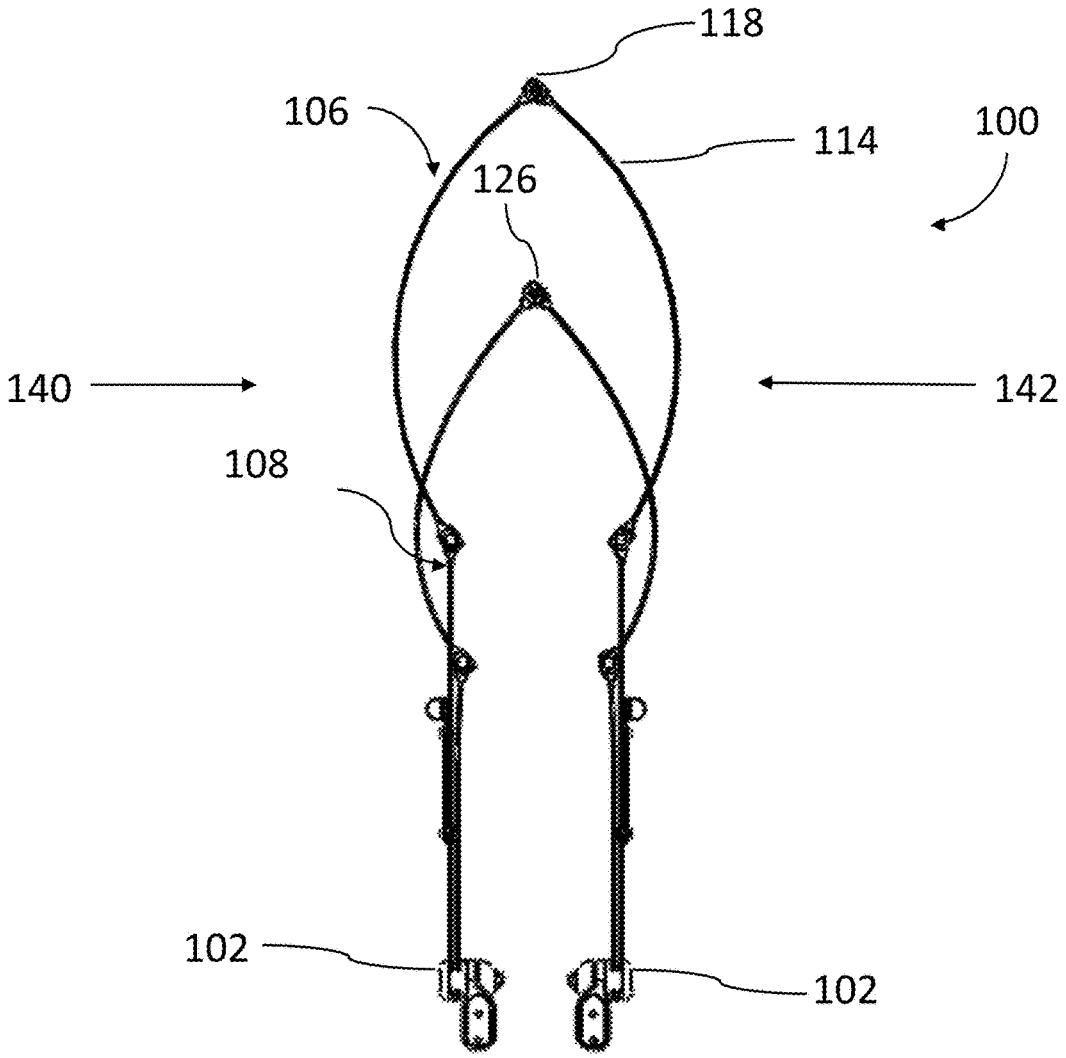
FIG. 2 shows a front view of the transverse folding shade frame of FIG. 1 in a folded and closed position.
Figure 3:
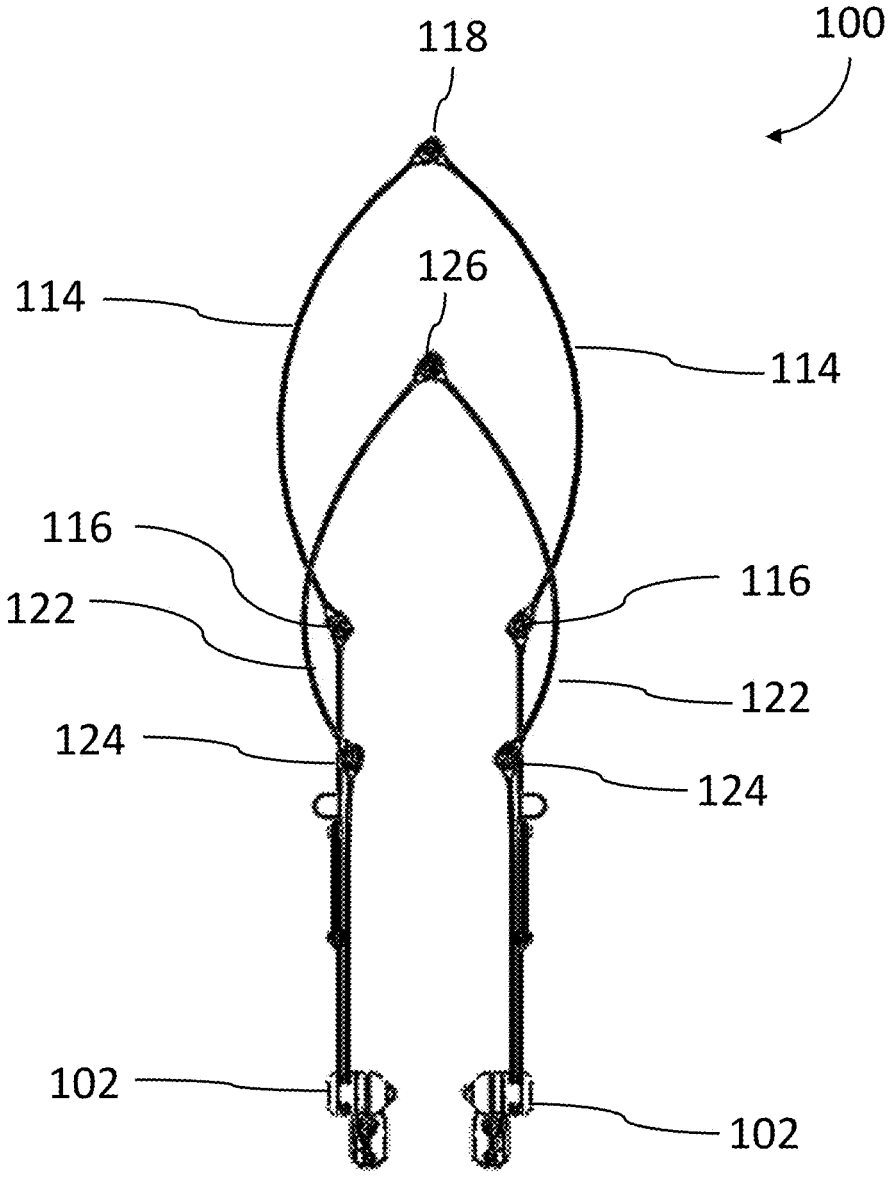
FIG. 3 shows a rear view of the transverse folding shade frame of FIG. 1 in a folded and closed position.
Figure 4:
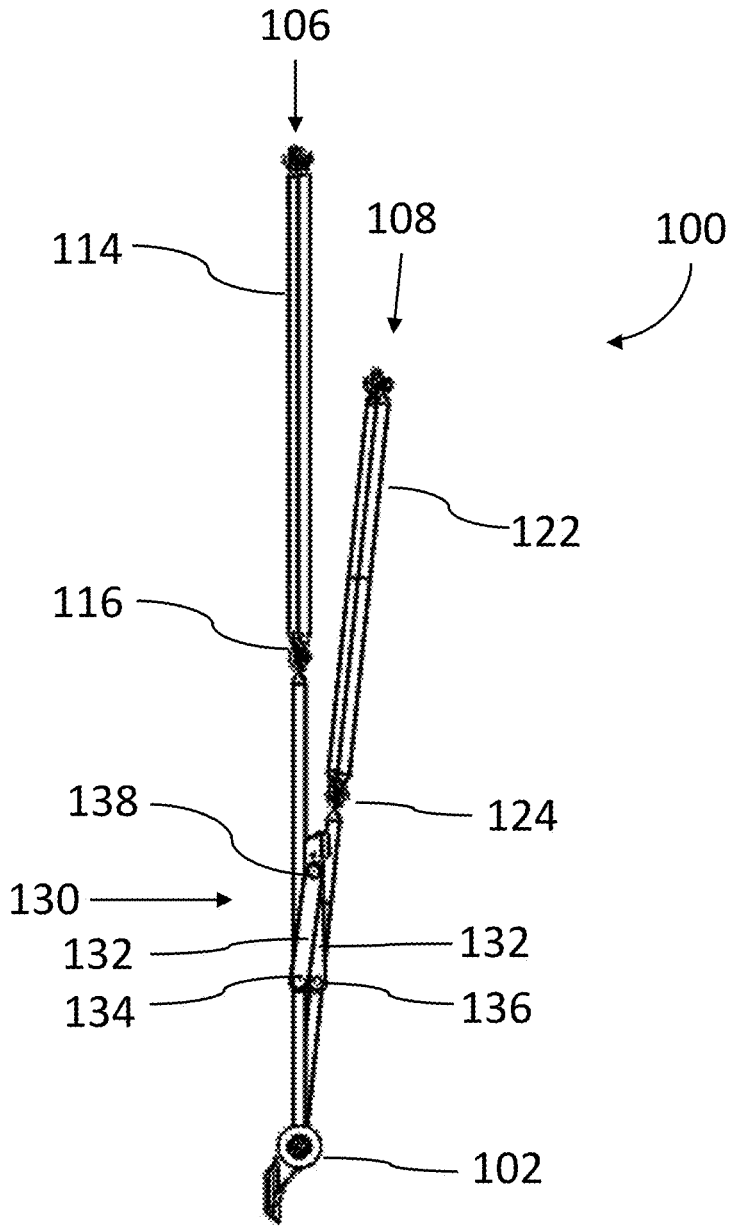
FIG. 4 shows a right side view of the transverse folding shade frame of FIG. 1 in a folded and closed position.
Figure 5:
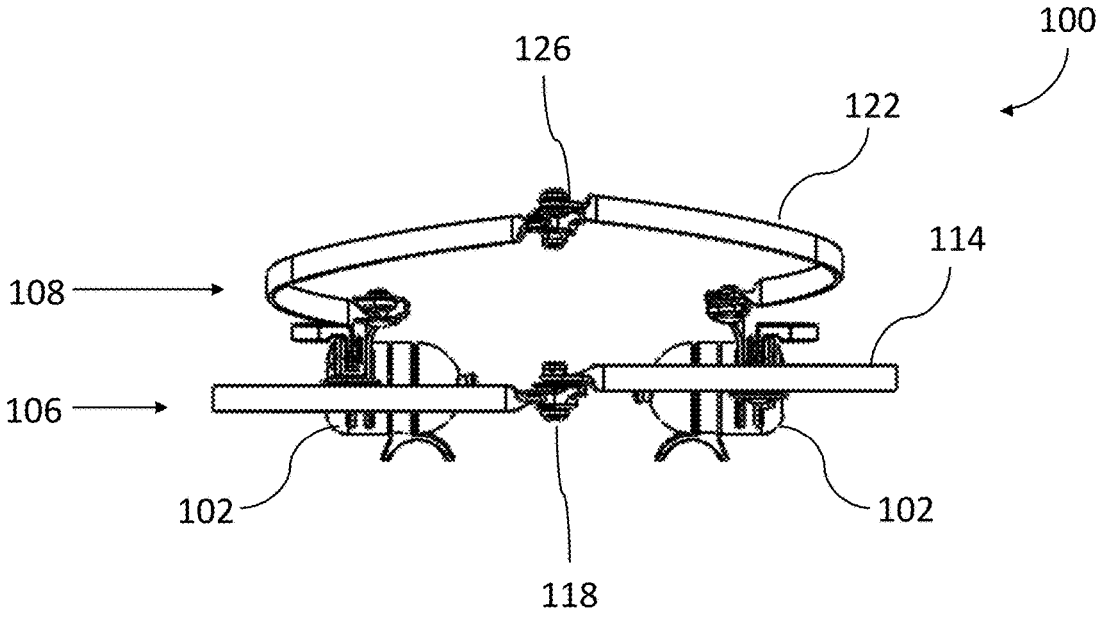
FIG. 5 shows a top view of the transverse folding shade frame of FIG. 1 in a folded and closed position.
Figure 6:
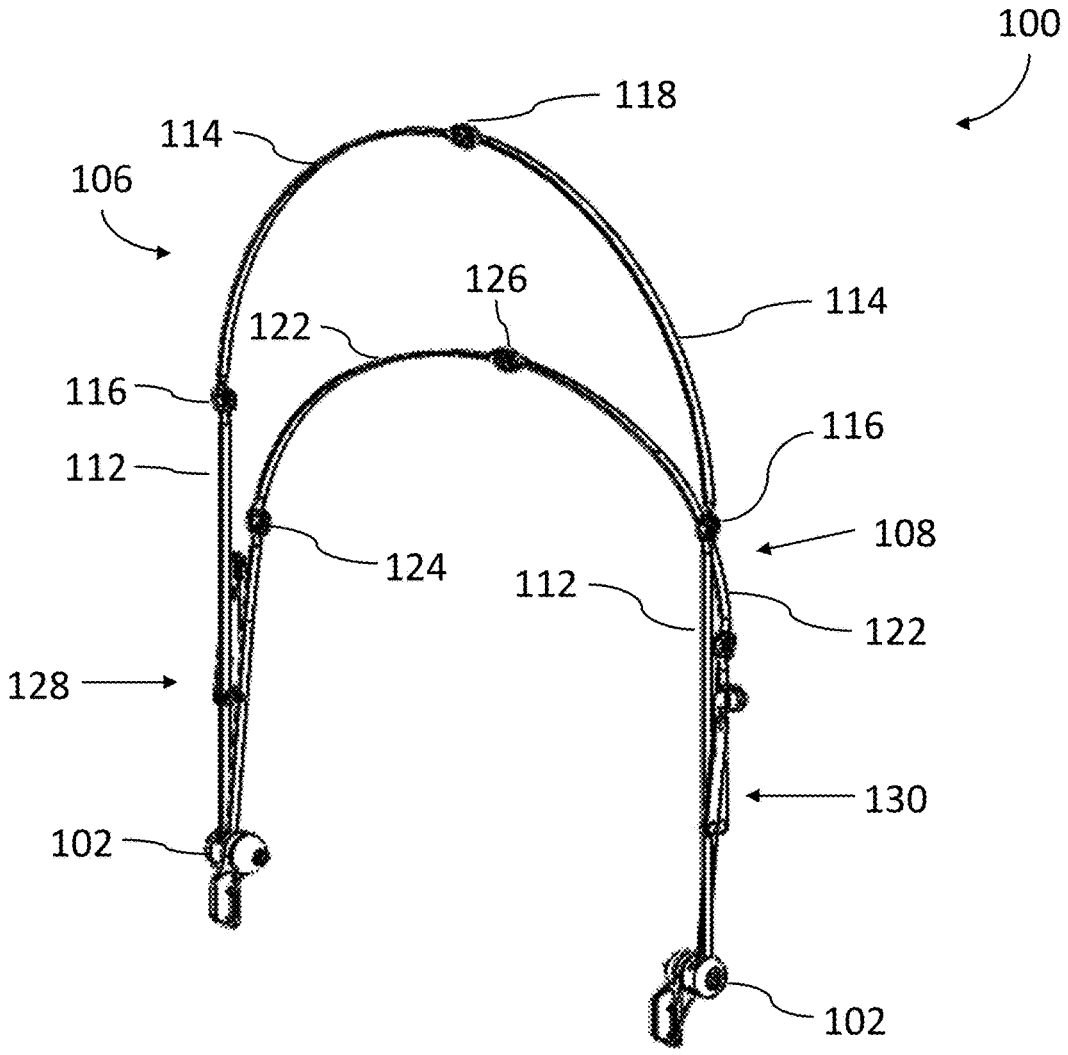
FIG. 6 shows a front, right perspective view of the transverse folding shade frame of FIG. 1 in an unfolded and closed position.
Figure 7:
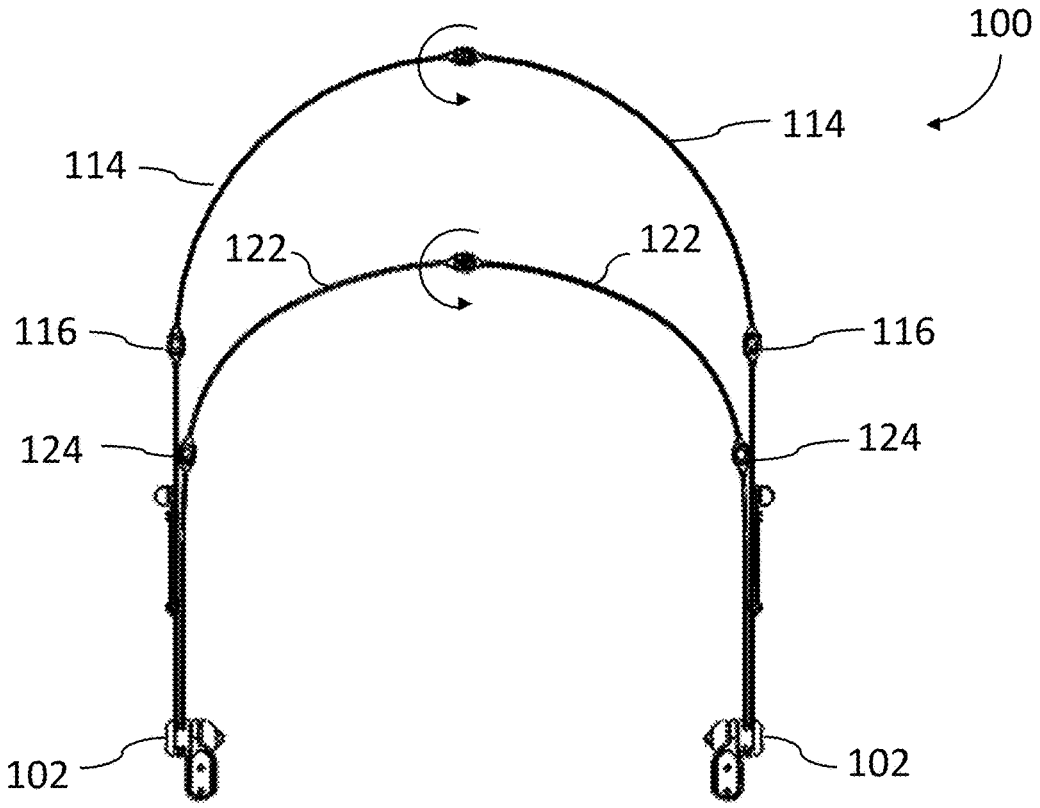
FIG. 7 shows a front view of the transverse folding shade frame of FIG. 1 in an unfolded and closed position.
Figure 8:
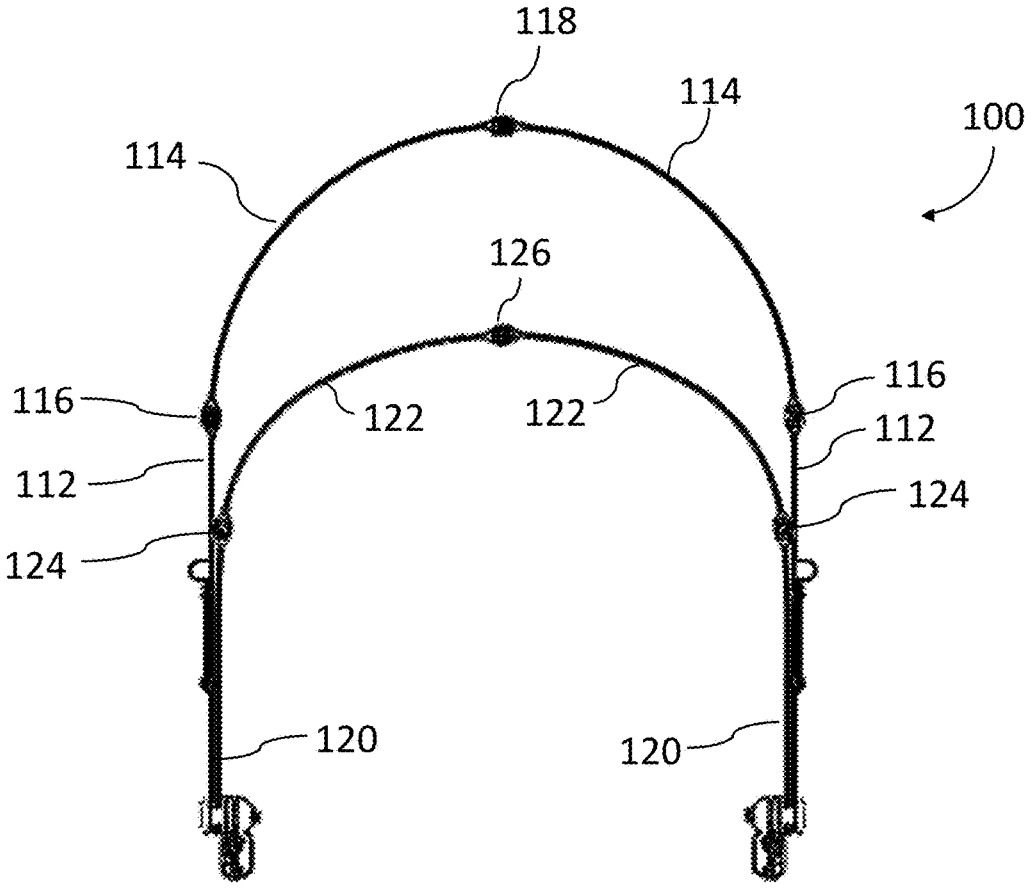
FIG. 8 shows a rear view of the transverse folding shade frame of FIG. 1 in an unfolded and closed position.
Figure 9:
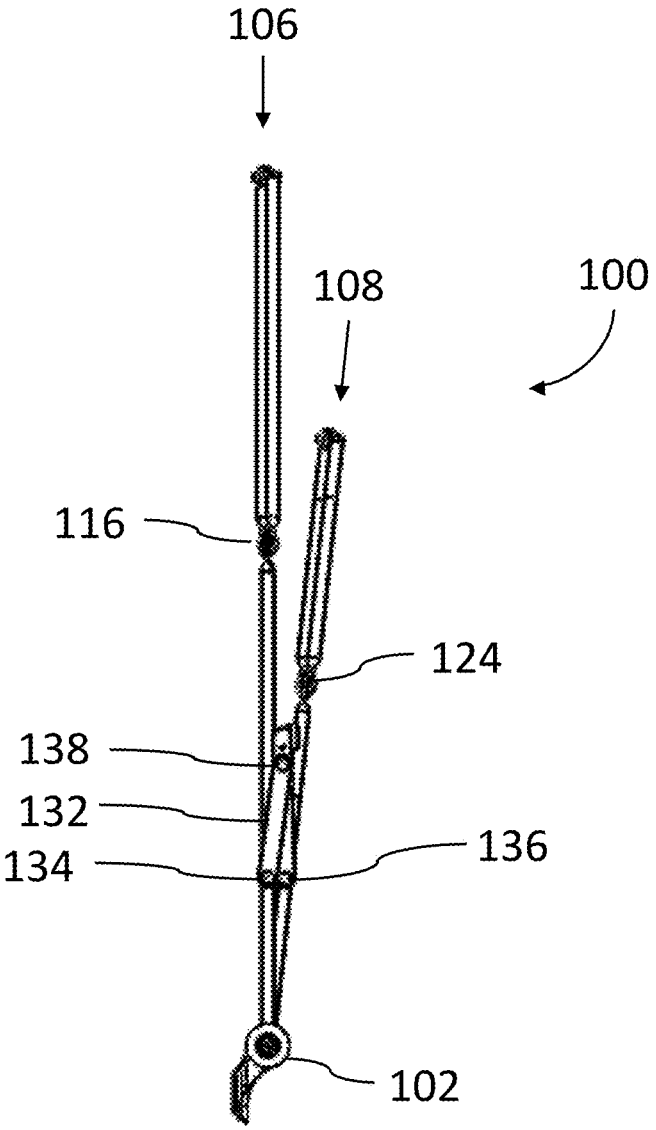
FIG. 9 shows a right side view of the transverse folding shade frame of FIG. 1 in an unfolded and closed position.
Figure 10:
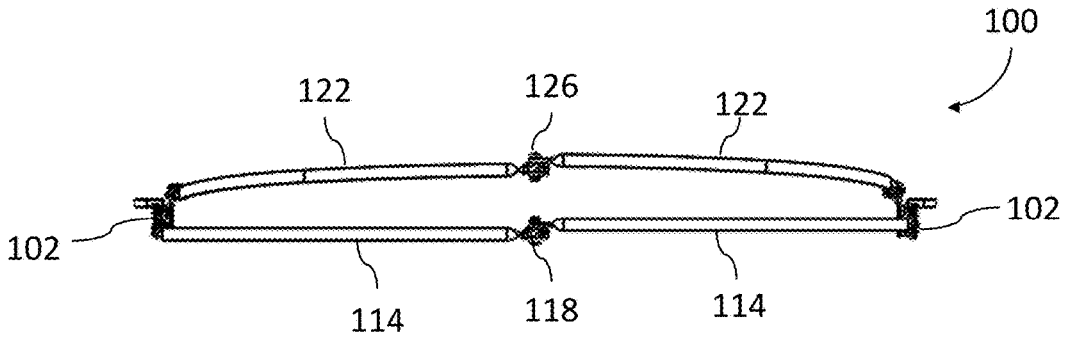
FIG. 10 shows a top view of the transverse folding shade frame of FIG. 1 in an unfolded and closed position.
Figure 11:
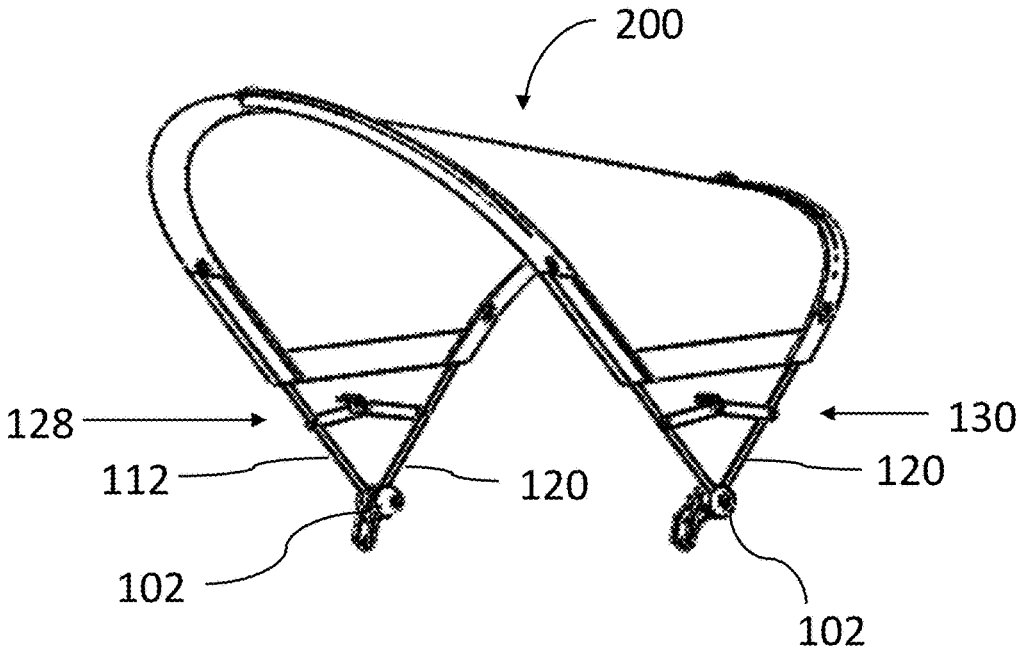
FIG. 11 shows a front, right perspective view of the transverse folding shade frame of FIG. 1 with a shade mounted thereon in an unfolded and open position.
Figure 12:
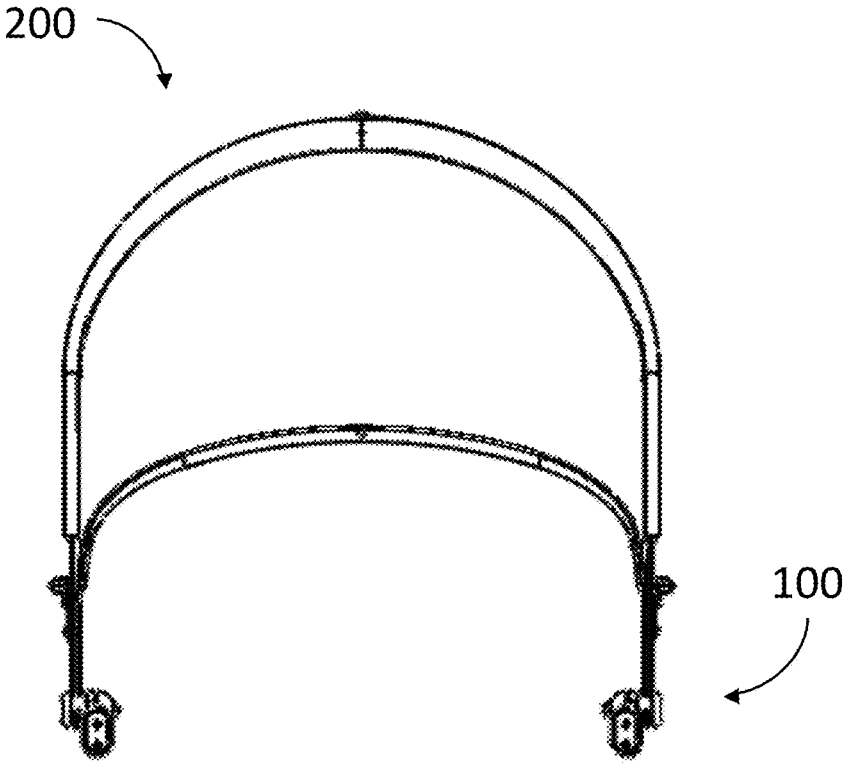
FIG. 12 shows a front view of the transverse folding shade frame of FIG. 1 with a shade mounted thereon in an unfolded and open position.
Figure 13:
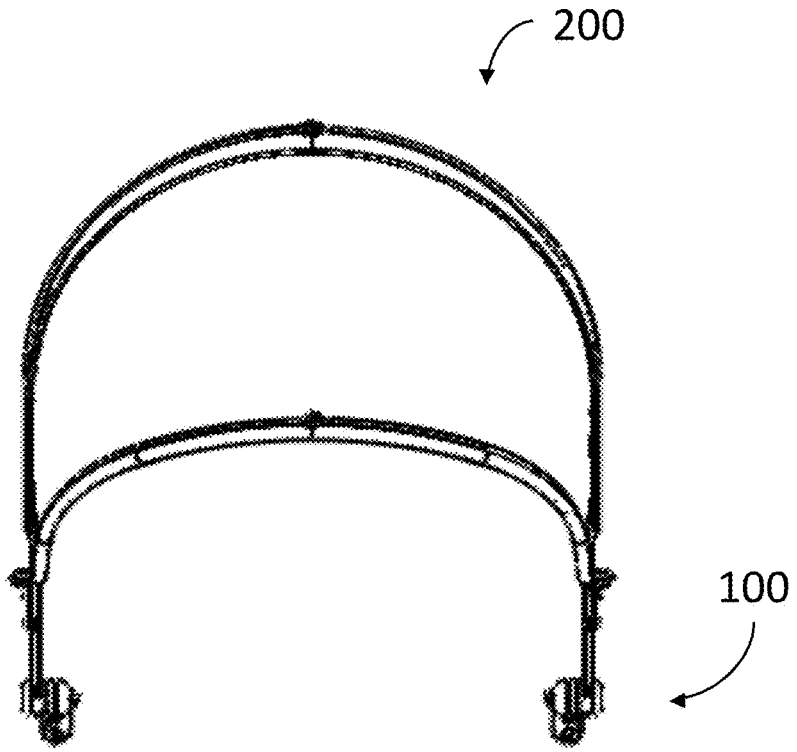
FIG. 13 shows a rear view of the transverse folding shade frame of FIG. 1 with a shade mounted thereon in an unfolded and open position.
Figure 14:
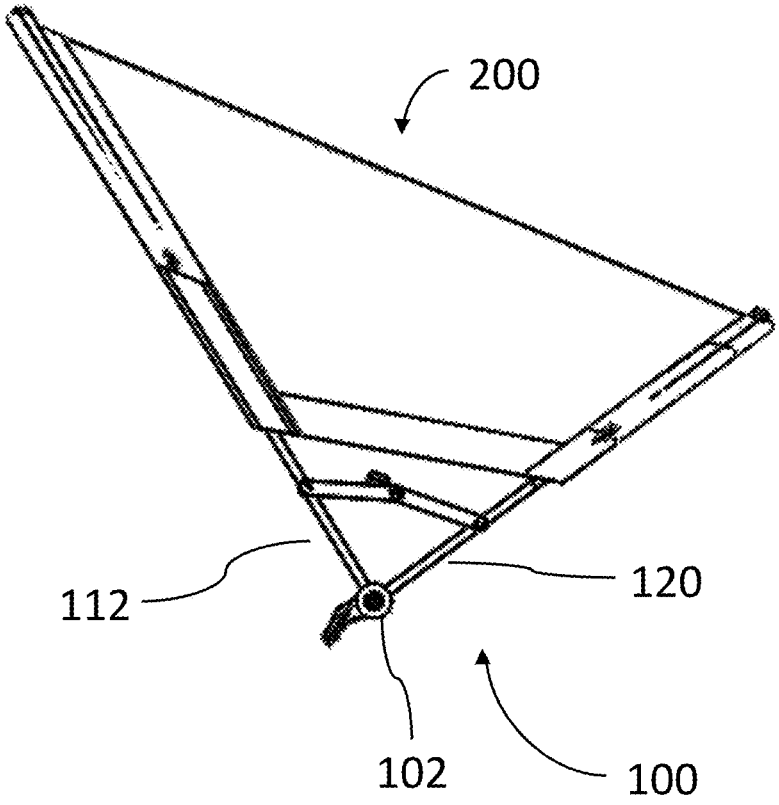
FIG. 14 shows a right side view of the transverse folding shade frame of FIG. 1 with a shade mounted thereon in an unfolded and open position.
Figure 15:
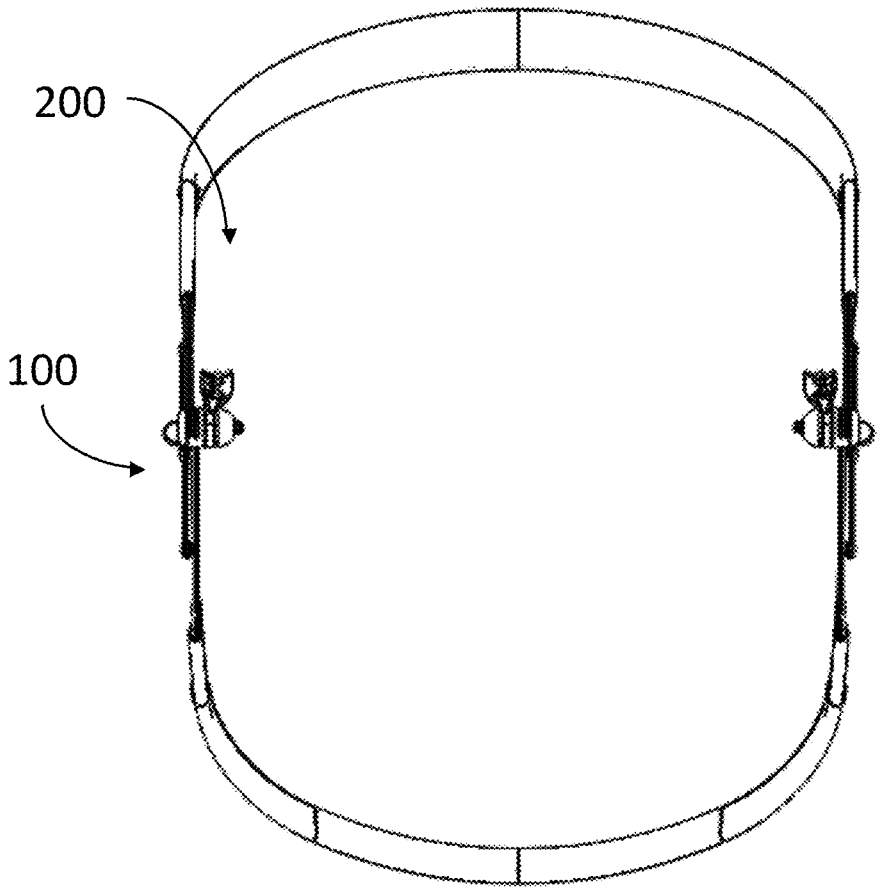
FIG. 15 shows a bottom view of the transverse folding shade frame of FIG. 1 with a shade mounted thereon in an unfolded and open position.

Although embodiments of the present disclosure are shown in the drawings and are described for use in connection with chairs, it should be readily understood that aspects of the present disclosure may be applicable to other furnishings, e.g., cots, tables, stools, and the like.

A transverse folding shade according to the present disclosure includes a shade membrane mounted onto a folding frame 100, of which, the shade membrane 200 will be discussed in greater detail below. Referring to FIGS. 1-5, the folding frame 100 according to the present disclosure is shown from various views in a closed and folded position. The folding frame, as illustrated, generally includes a pair of hubs 102 with mounting portions 104 for connecting the shade 200 to a chair 300, a front assembly 106, a rear assembly 108 and assembly linkage 110. The front assembly 106 includes a pair of front support members 112 each of which are pivotally connected to respective front arc members 114 via front support-arc pivots 116. The front arc members 114 are pivotally connected to each other via an arc-arc pivot 118. Each front support member 112 is rotatably connected to a respective hub 102 of the pair of hubs 102.

Similar to the front assembly, the rear assembly includes a pair of rear support members 120 which are pivotally connected to respective rear arc members 122 via rear support-arc pivots 124. The rear arc members 122 are pivotally connected to each other via an arc-arc pivot 126. Each rear support member 120 is rotatably connected to a respective hub 102 of the pair hubs 102. Accordingly, one hub 102 is connected to one front support member 112 and one rear support member 120 and the other hub 102 is connected to the other front support member 112 and rear support member 120.

The assembly linkage 110 connects the front assembly 106 with the rear assembly 108, and is generally provided to lock the front and rear assemblies 106, 108 relative to one another in a set-up condition of the shade 200 whereby the front and rear assemblies are angularly positioned relative to one another, as well as to help the shade 200 maintain its shape in use, generally in combination with the structure provided by the front and rear assemblies 106, 108 and the fabric membrane 200. The assembly linkage 110 includes a first linkage 128 and a second linkage 130. The first linkage 128 connects one front support member 112 of the front assembly 106 with the rear support member 120 of the rear assembly 108 that is connected to the same hub 102 as that front support member 112. The second linkage 130 connects the other front support member 112 and rear support member 120 that are also connected to a mutual hub 102. As shown, the first linkage 128 and second linkage 130 each include two flat links 132. One flat link 132 is pivotally connected to the front support member 112 via a front support pin 134. The other flat link is pivotally connected to the rear support member 120 by a rear support pin 136. The flat links 132 are pivotally connected to each other via a link pin 138.

In use, the assembly linkage 110 locks the front and rear assemblies 106, 108 in position for use of the shade 200. Preferably, once the assembly linkage 110 is locked, the opened shade 200 may be pivoted at the hubs 102 to adjust the position of the shade 200 relative to the chair 300—for example, to accommodate for the movement of the sun without needing to move the entire chair 300. In this scenario, the ends of the front and rear assemblies 106, 108 can be adjustable at the hubs 102, and then locked into place once the shade 200 is at a desired position.

A first side 140 of the folding frame 100 is formed by one hub 102, the front support member 112 connected to that hub 102, the rear support member 120 connected to that hub 102, the first linkage 128 connecting that front support member 112 and rear support member 120, the front arc member 114 connected to that front support member 112 and the rear arc member 122 connected to that rear support member 120. A second side 142 of the folding frame 100 is formed by the other hub 102, the front support member 112 connected to that hub 102, the rear support member 120 connected to that hub 102, the second linkage 130 connecting that front support member 112 and rear support member 120, the front arc member 114 connected to that front support member 112 and the rear arc member 122 connected to that rear support member 120.

The front and rear support-arc pivots 116, 124 and the front and rear arc-arc pivots 118, 126 permit transverse, or side-to-side, folding of the folding frame 100 from a transversely folded position to an unfolded position, and vice-versa. FIGS. 1-5 show the folding frame 100 in a transversely folded position, in other words, a position where the first side 140 of the folding frame is relatively close to the second side 142 of the folding frame. FIGS. 6-10 show the folding frame 100 in an unfolded position, in other words, a position where the first side 140 of the folding frame 100 is further from the second side 142 of the folding frame 100 compared to the distance between the first side 140 of the folding frame 100 and second side 142 of the folding frame 100 when the folding frame 100 is in the folded position. The folding frame 100 in its unfolded position is generally the same width as the set up chair 300 frame. As shown, the arc-arc pivots 118, 126 pivotally connecting the front arc members 114 and the rear arc members 122 allow the folding and unfolding to occur in substantially the same plane that the front arc members 114 and rear arc members 122 are arranged in.

The hubs 102 and linkage assembly 110 permit opening of the folding frame 100 from a closed position to an open position for the shade 200, and vice-versa. As discussed above, the front assembly 106 and rear assembly 108 are rotatably connected to the hubs 102. Thus, rotation at the hubs 102 permits mutual movement between the front assembly 106 and rear assembly 108. The first linkage 128 and second linkage 130 permit such mutual movement due to their pivotal connections, as discussed above. FIGS. 1-10 show the folding frame 100 in a closed position of the shade 200, in other words, a position where the front assembly 106 is relatively close to the rear assembly 108. FIGS. 11-15 show the folding frame 100 in an open position of the shade 200, in other words, a position where the front assembly 106 is further from the rear assembly 108 compared to the distance between the front assembly 106 and rear assembly 108 when in the closed position. Generally, in the open position of the shade 200, the front and rear assemblies 106, 108 are angularly positioned relative to one another so as to provide adequate shade and coverage to a person seated in the chair 300. As noted above, the position of the open shade 200 can be adjusted relative to the chair 300 frame to maximize its use.

In alternate designs, additional or different "rib" assemblies can be used, both in connection with the front and rear assemblies 106, 108 illustrated in FIGS. 1-5, or instead of the front and rear assemblies 106, 108. For example, front-back ribs can be provided in the fabric member 200. Alternately, additional transverse arcing ribs can be provided within the fabric or otherwise supporting the fabric 200 and positioned between the front assembly and the rear assembly, which could permit for a wider expanse of the fabric membrane 200. When collapsed, the transverse rib members would generally fold together, capturing the fabric material for storage next to and/or within the folding frame of the chair.

Figure 24:
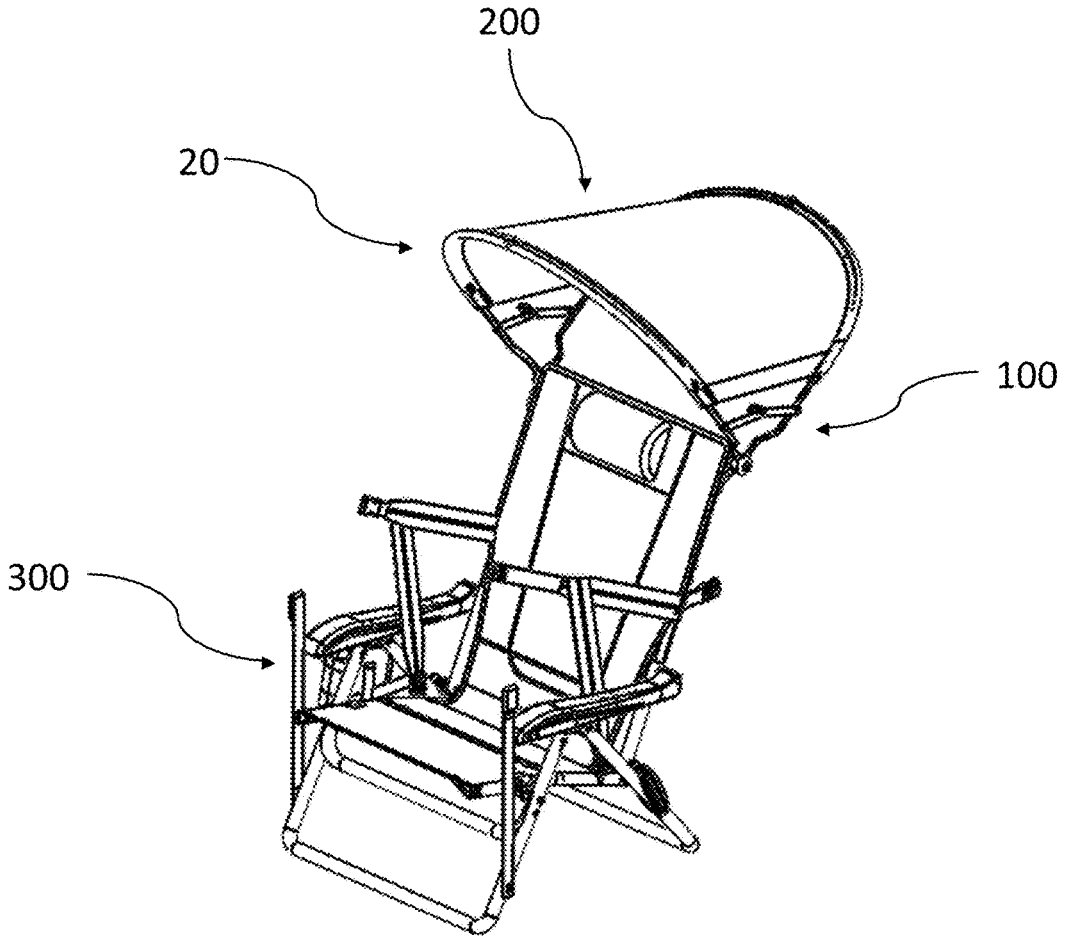
FIG. 24 shows a front, right perspective view of another exemplary transverse folding shade in an unfolded and open position fixed to the back of a folding chair in an unfolded position according to the present disclosure.
Figure 25:
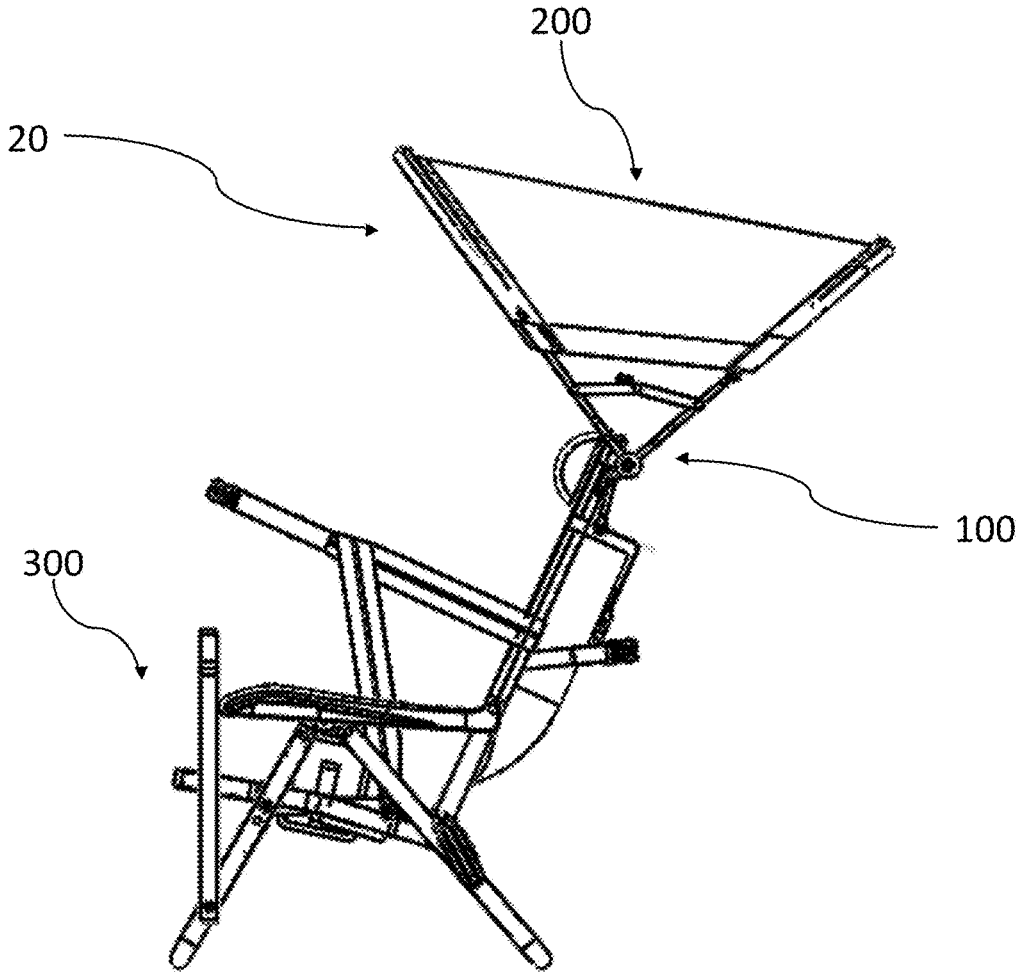
FIG. 25 shows a right view of the transverse folding shade of FIG. 24.
Figure 26:
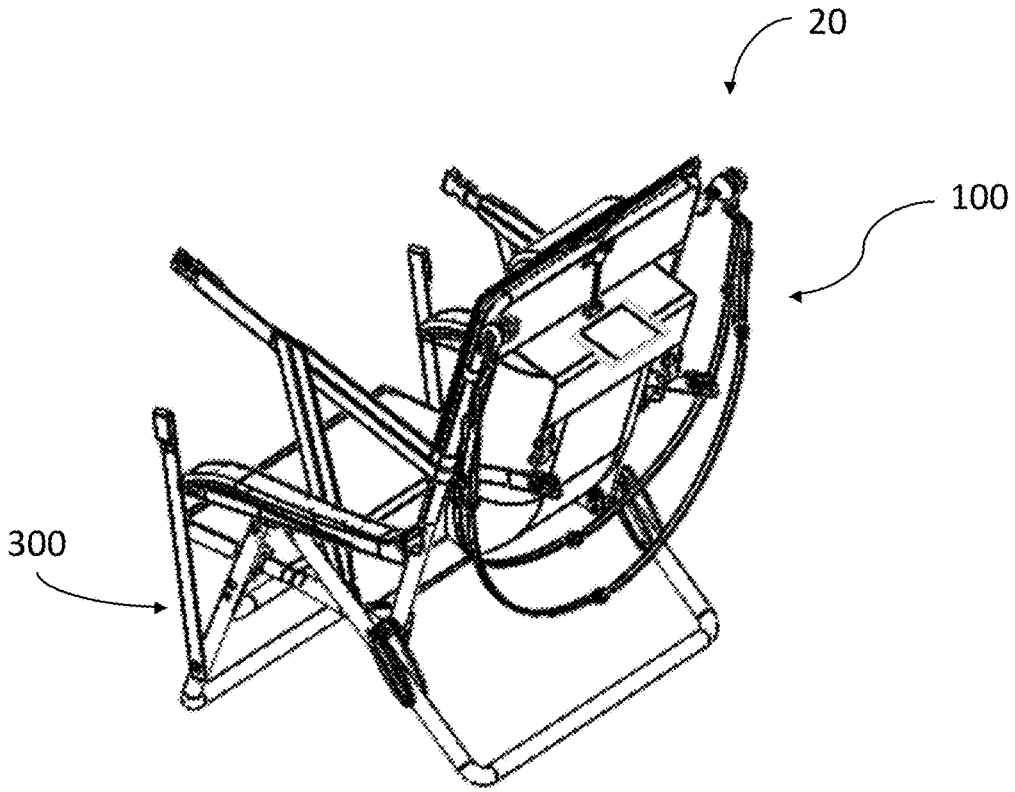
FIG. 26 shows a rear, right perspective view of the transverse folding shade of FIG. 24 with the shade removed and in the closed position.
Figure 27:
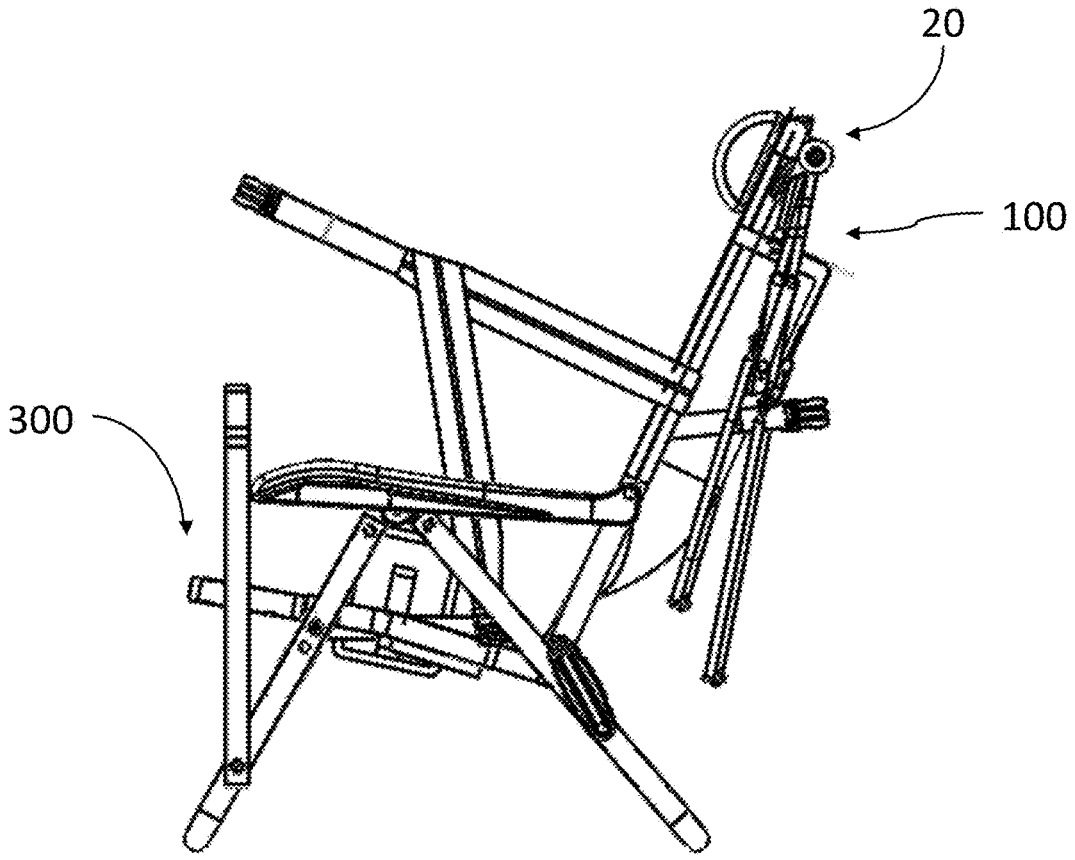
FIG. 27 shows a right view of the transverse folding shade of FIG. 24 with the shade removed and in the closed position.
Figure 28:
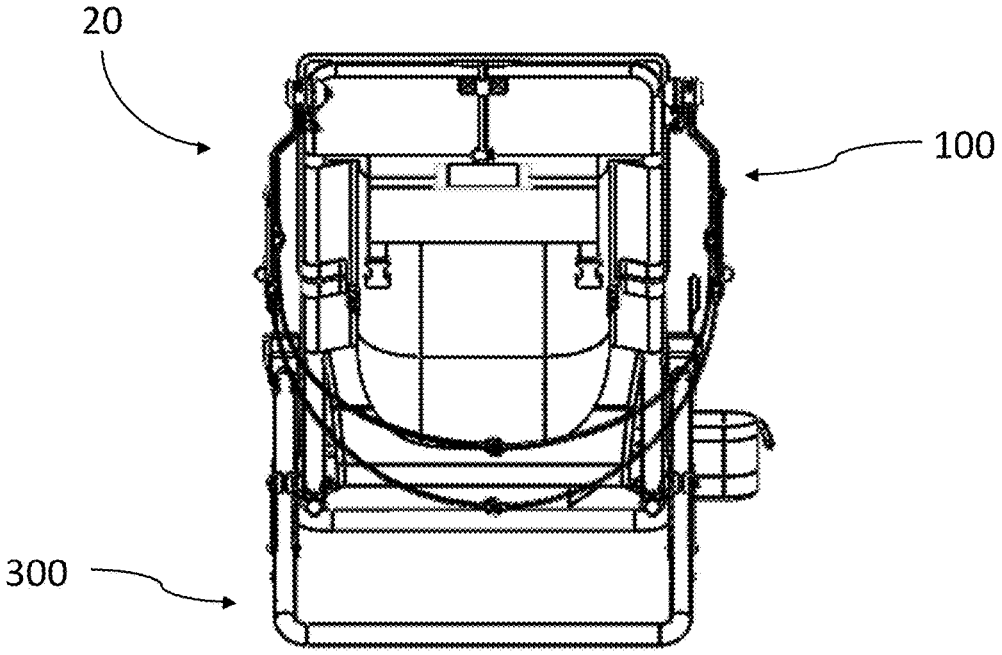
FIG. 28 shows a rear view of the transverse folding shade of FIG. 24 with the shade removed and in the closed position.

In still further alternate embodiments, the front and rear assemblies 106, 108 can utilize one-piece arced members 114, 122 that transversely extend from one hub 102 to the opposite hub 102. This design would generally be used with a common flat-fold chair design, where, in use, the front and rear assemblies 106, 108 can be pivoted at the hubs 102 to a closed condition where they lie adjacent one another, and where further, the closed assemblies can be pivoted at the hubs 102 to a storage position generally laying behind and adjacent to the back rest so as to not interfere with folding of the chair 300. In this regard, the folded shade 200 folds flat with the chair frame 300 for transport and/or storage. Such an embodiment is generally illustrated in FIGS. 24-25.

Referring to FIGS. 11-15, the shade membrane 200 is shown mounted on the folding frame 100 with the folding frame 100 shown in its open and unfolded position. The shade membrane 200 is preferably made of fabric and/or polymer material such that the shade membrane 200 may fold with the folding frame 100 when the folding frame 100 is moved to the closed and/or folded positions. For example, the shade membrane 200 may be made of flexible but durable materials such as canvas, plastic, polymer blends, or the like. In embodiments, the shade membrane 200 may provide the structural rigidity that gives the transverse folding shade its shape when the folding frame 100 is opened and unfolded, thereby allowing the folding frame 100 to be made from more flexible materials than would otherwise be permitted, which may provide cost savings. In general, when the folding frame 100 is opened and unfolded, such as illustrated, for example, in FIG. 14, the membrane 200 is taut between the front and rear assemblies 106, 108, so long as the front and rear assemblies 106, 108 are locked in position at the hubs 102. When the front and rear assemblies 106, 108 are unlocked at the hubs 102, the membrane 200 generally relaxes, permitting the front and rear assemblies 106, 108 to be pivoted towards each other to the closed position of the folding frame 100. The relaxed membrane 200 can fold with and within the closed frame 100. Thereafter, the folding frame 100 can be further transversely folded with the membrane 200 folding with the frame 100 without impeding movement of the frame assemblies 106, 108 or any ribs. Further, the shade membrane 200 may be constructed to have holes in the areas where the arc-arc pivots 118, 126 are arranged to prevent inhibition of folding and unfolding of the folding frame 100.

Figure 16:
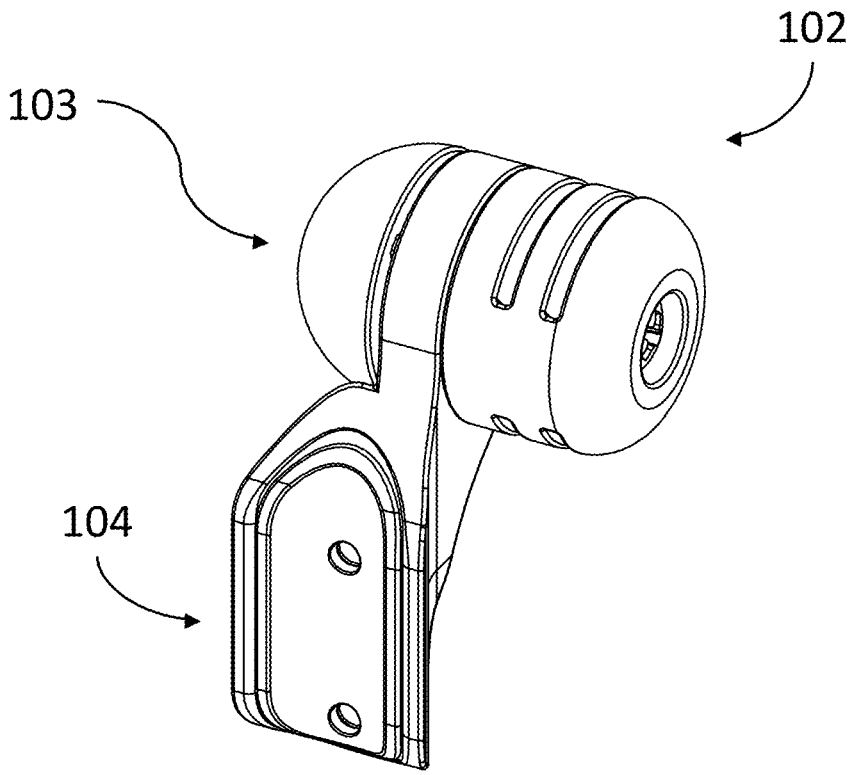
FIG. 16 shows a front, right and top perspective view of an exemplary hub of a transverse folding shade according to the present disclosure.
Figure 17:
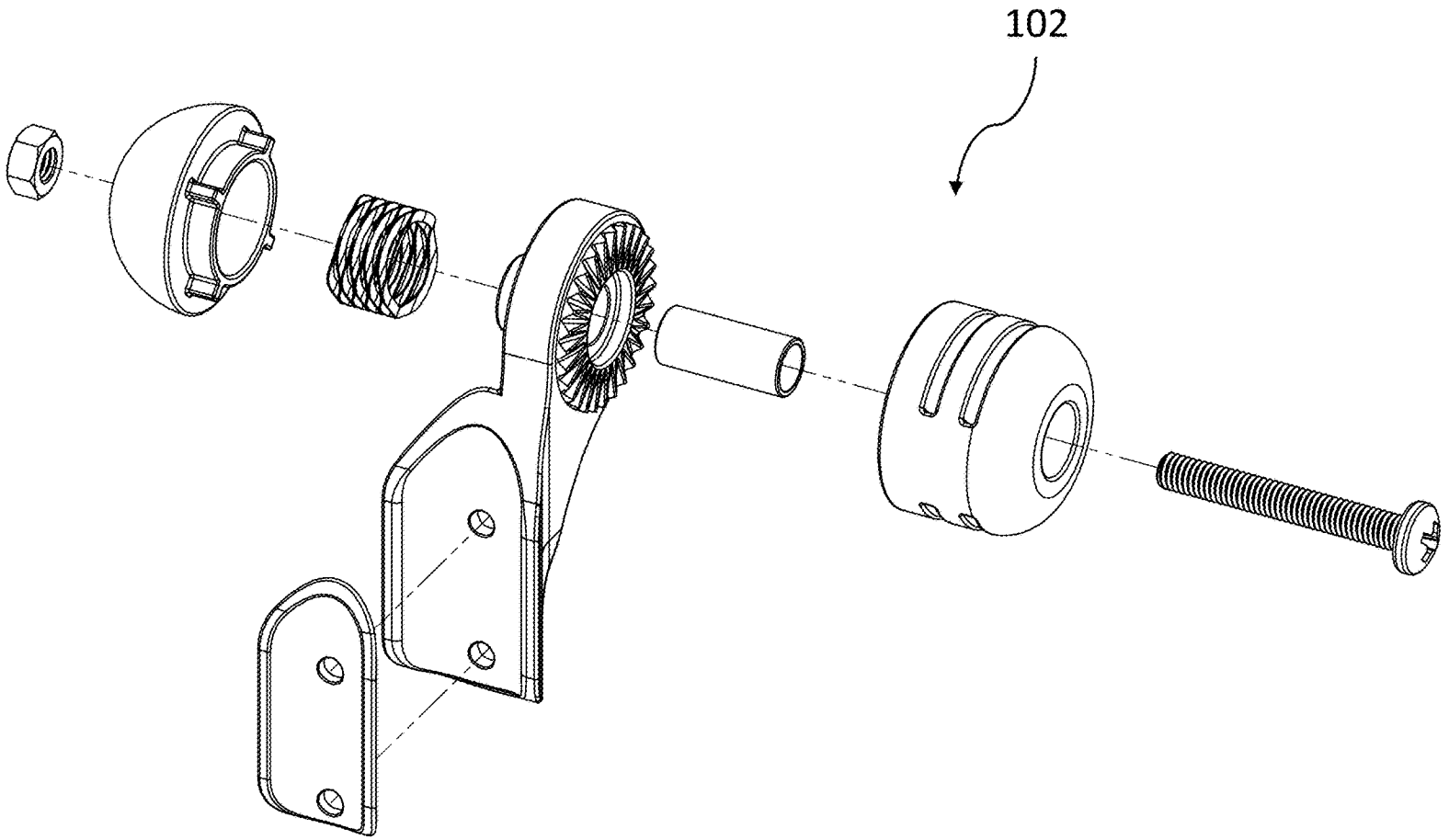
FIG. 17 shows an exploded view of the hub of FIG. 11.

Referring to FIGS. 16 and 17, the hubs 102 include a rotating portion 103 rotatably connected to a mounting portion 104. The front assembly 106 and rear assembly 108 are rotatably connected to the hubs 102 through connections with the rotating portions 103 of the hubs 102. The mounting portion 104 is configured to be permanently affixed to, or alternatively removably attached to, folding furniture, for example, a folding chair 300. In this regard, the folding shade 10 and folding frame 100 disclosed herein can either be pre-mounted to a chair 300 frame or retroactively mounted to an existing chair 300. The rotating portion 103 is configured to rotate to and through a plurality of stops. The plurality of stops in the rotating portions 103 of the hubs 102 permits the folding frame 100 to reach a plurality of intermediate positions between the closed position and open position. The hubs 102 may be configured such that they can be locked or tightened to limit rotation and then conversely loosened to allow adjustment, as desired.

Figure 18A:
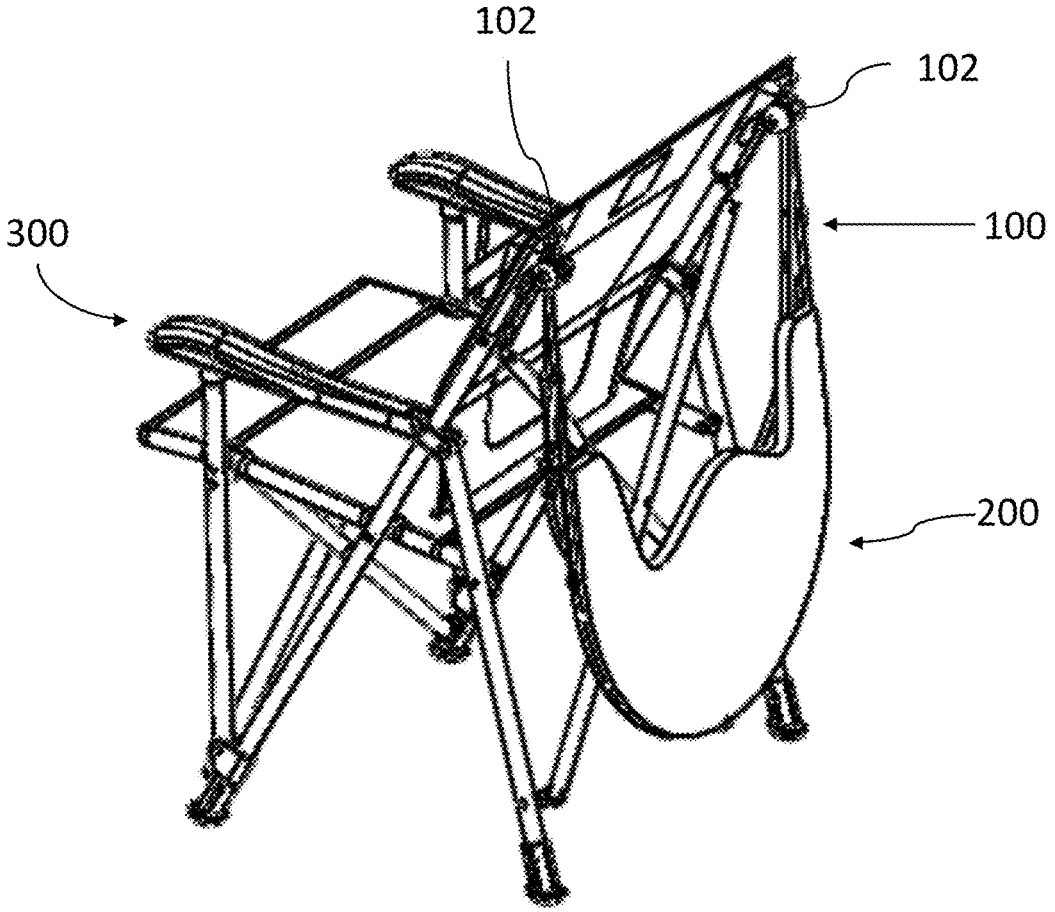
FIG. 18A shows an exemplary transverse folding shade in an unfolded and closed position fixed to the back of a folding chair in an unfolded position according to the present disclosure.
Figure 18B:
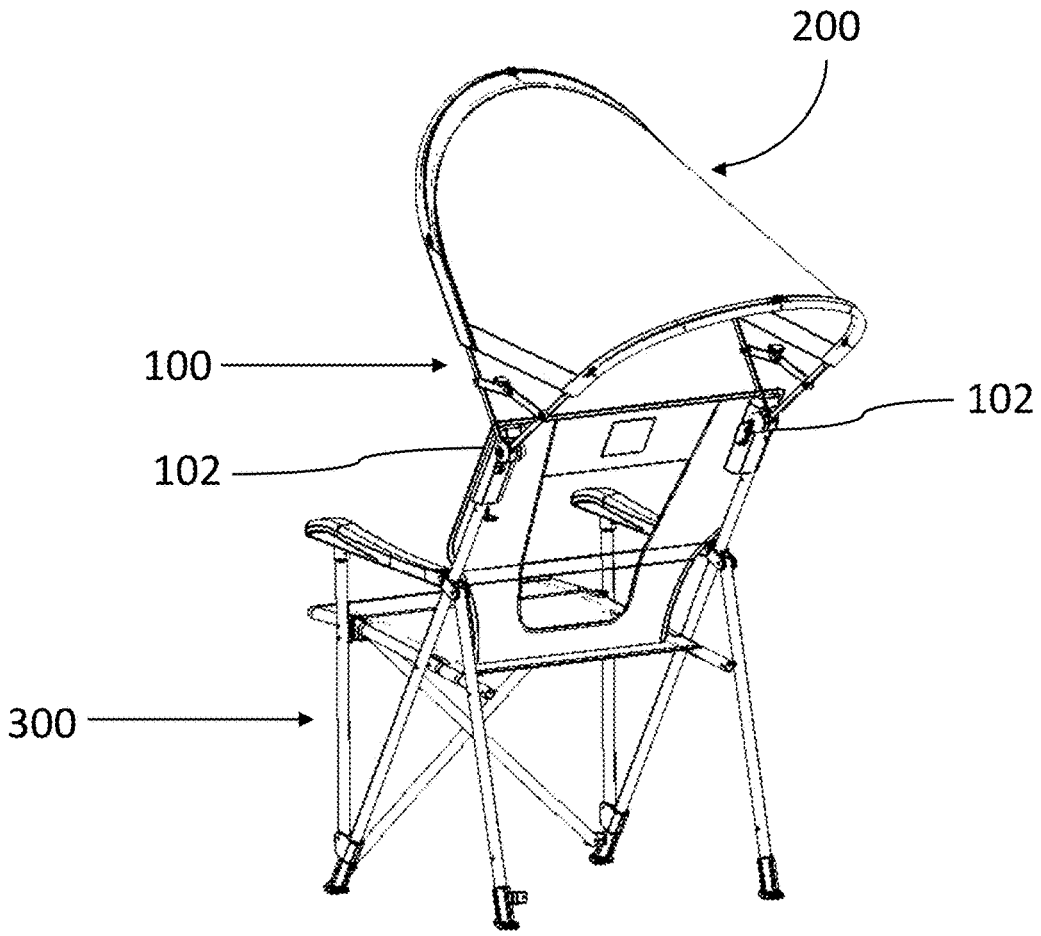
FIG. 18B shows the transverse folding shade of FIG. 18A in an unfolded and opened position fixed to the back of a folding chair in an unfolded position according to the present disclosure.
Figure 19:
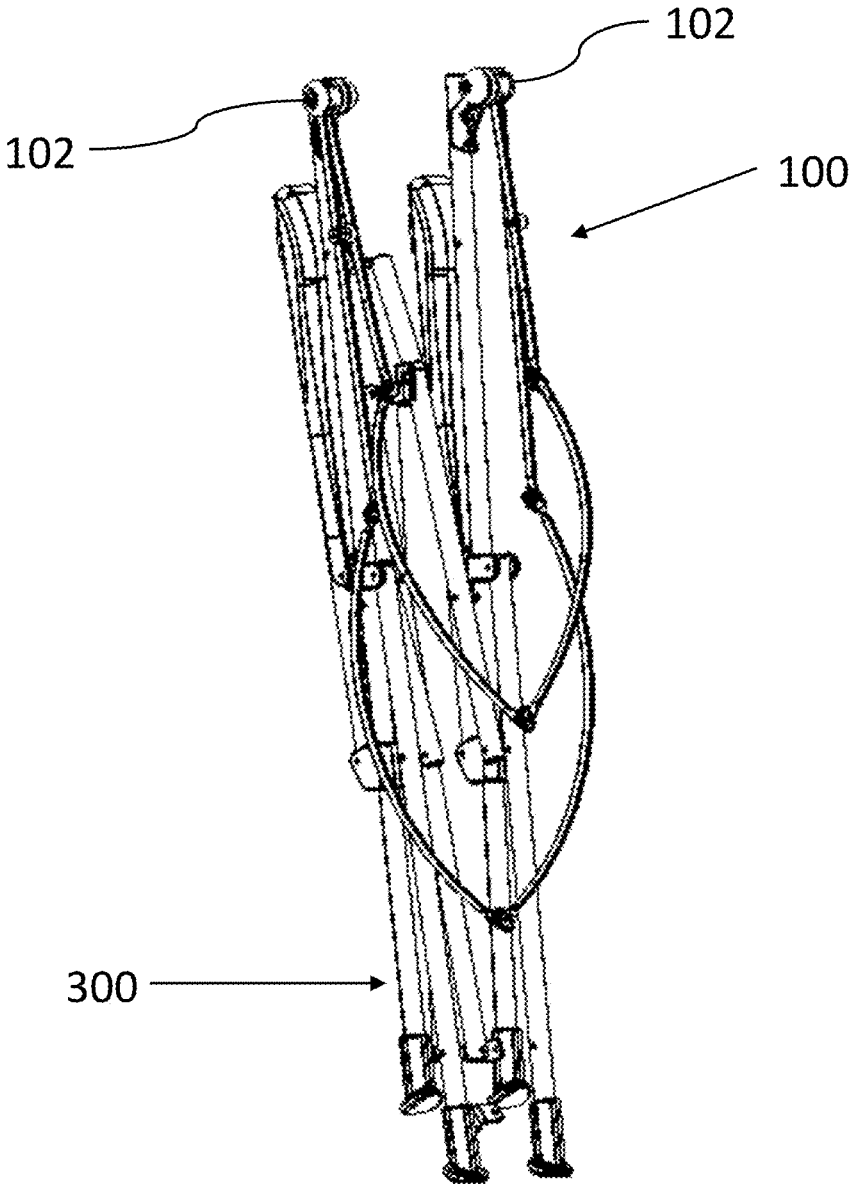
FIG. 19 shows the transverse folding shade of FIG. 18A, without the shade, in a folded and closed position fixed to the back of a folding chair in a folded position.
Figure 21:
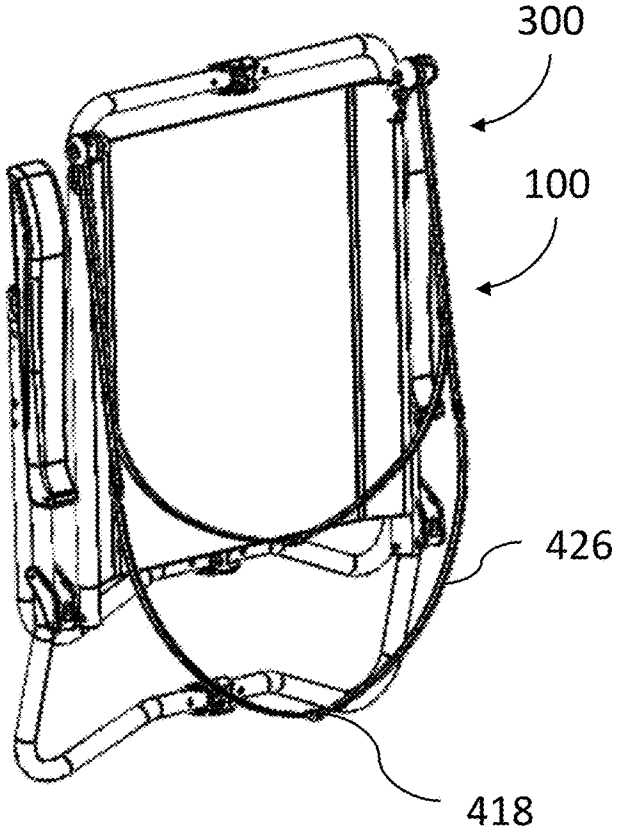
FIG. 21 shows a left, front view of the transverse folding shade of FIG. 20 in an unfolded and closed position fixed to the back of a bi-fold folding chair in a partly folded position.
Figure 20:
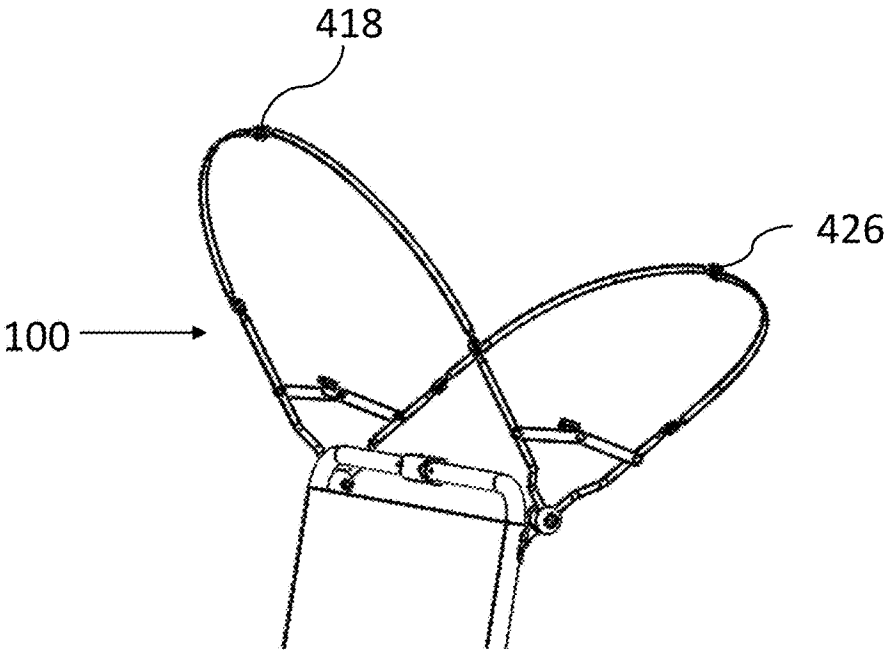
FIG. 20 shows a front, right perspective view of another exemplary transverse folding shade in an unfolded and open position fixed to the back of a bi-fold folding chair in an unfolded position according to the present disclosure.
Figure 23:
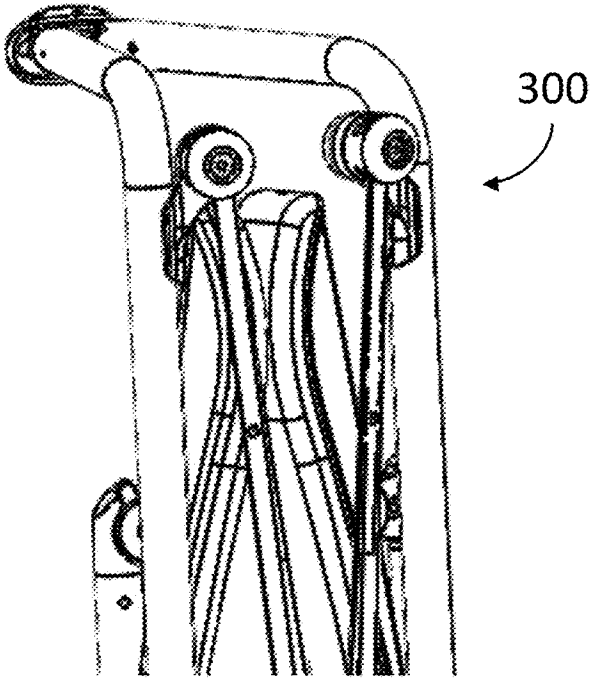
FIG. 23 shows a left, front view of the transverse folding shade of FIG. 20 in a folded and closed position fixed to the back of a bi-fold folding chair in a folded position.
Figure 22:
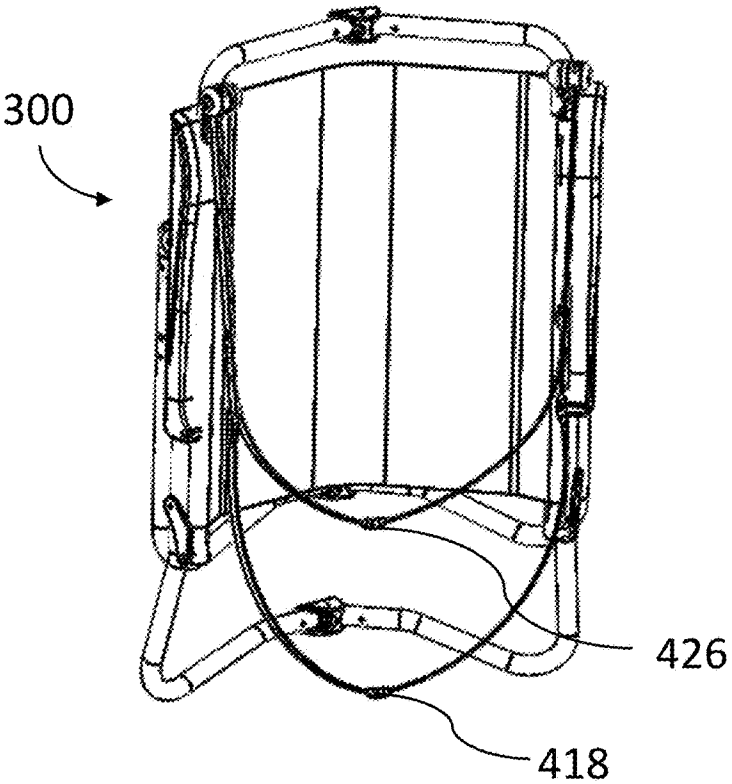
FIG. 22 shows a left, front view of the transverse folding shade of FIG. 20 in a partly folded and closed position fixed to the back of a bi-fold folding chair in a partly folded position.

In operation, the rotation of the front assembly 106 and rear assembly 108 about the hubs 102 allows adjustment of the shade 200 as desired by a user, for example, to move the mounted shade 200 in order to provide cover from incoming sunlight directed at the user at a certain angle. The hubs 102 also allow rotation folding frame 100 such that the transverse folding shade may be positioned to minimize interference with the user while folding the chair 300, for example, to a position behind the back of the folding chair 300, as shown in FIG. 18A. Alternatively, the shade 200 can be mounted to this "rest" position behind the back of the chair 300 even when the chair is set-up, such as when the shade 200 is not needed or desired. The shade 200 can be rotated from this rest position back to a "use" position, or open position, as shown in FIG. 18B. Thus, the hubs 102 provide a wide range of rotatable positions. As shown in FIG. 19, the folding chair 300 to which the transverse folding shade 10 is permanently or removably attached to may fold even when the shade 200 is in the position where minimally interfering with the user.

According to embodiments of the present disclosure, the transverse folding shade 10 may fold from the folded position to the unfolded position, and vice-versa, in a different manner than as described above. Referring to FIGS. 20-23, an exemplary transverse folding shade 410 is shown that allows for folding and unfolding where the front arc members 414 and the rear arc members 422 fold towards each other. This bi-folding action is different than the folding action described above, where the front arc members 114 and rear arc members 122 transversely collapse towards each other in substantially the same plane that the front arc members 114 and rear arc members 122 are arranged in. In such a bi-fold arrangement, the arc-arc pivot 418, 426 on the front and rear assembly 406, 408 are turned substantially 90° from the orientation as shown and described in FIGS. 1-15. Thus, the closed folding frame can be folded in half with similar folding of the collapsed chair 300 frame, much like a book, where the shade is folded within the chair frame for storage and/or transport.

Referring to FIGS. 24-28, embodiments of the present disclosure may include an embodiment of a folding shade 20 in accordance with the present invention having ribs that are one piece. As discussed above, the arc members may be configured as one piece. In this configuration, the shade 200 may be collapsed by rotation at the hubs 102, as discussed above, such that the shade 200 is "backpacked" and the shape of the collapsed folding frame 100 in a "rest" position on the back side of the back support of the chair 300 where the folding frame 100 goes around the backpack pouch or pouches without interfering with use of such pouch(es), such as when the chair is carried like a backpack. The shade 200 may be sewn to provide the necessary elasticity to allow for this type of collapsible configuration. Accordingly, when the transverse folding shade 20 is in such a collapsed condition, i.e. "backpacked," and the chair 300 that the transverse folding shade 20 is mounted to is in a collapsed condition, the chair 300 and transverse folding shade 20 may be worn by a user in a backpack fashion. This may be advantageous for transporting the chair 300 and transverse folding shade 20. In general, the hubs 102 used to attach the folding frame to the chair are of the same construction as shown in FIGS. 16 and 17, and operate in the same manner as described above.

The present disclosure provides embodiments of folding shades that may close and/or fold without being removed from the folding furniture that it is permanently or removably attached to. This feature advantageously allows the folding shade to travel and/or be stored with folding furniture when the folding furniture is also closed and/or folded instead of being required to be separately removed for such travel or storage applications. Further, the since the folding shade is configured to close and/or fold while attached to folding furniture, the folding shade may not add any extra width to the folding furniture footprint when in the folded the position.

While the embodiments of a folding shade are shown in FIGS. 1-15 and 20-23 as having front arc members 114 that are larger than the rear arc members 122, it is within the scope of the present disclosure for embodiments to include front arc members that are the same size as rear arc members or front arc members that are smaller in size than rear arc members (or multiple arc members where applicable), without departing from the principles and spirit of the present invention.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A folding shade for use with a collapsible article of furniture comprising:

a folding frame including a first hub, a second hub, a front assembly rotatably connected to the first hub and second hub, and a rear assembly rotatably connected to the first hub and second hub, wherein the first hub includes a first mounting portion and the second hub includes a second mounting portion, and wherein the first mounting portion and the second mounting portion are configured to attach to the collapsible article of furniture; and a shade membrane connected to the front assembly and the rear assembly;

wherein the front assembly comprises:

a first front support member;

a first front arc member connected to the first front support member;

a second front support member; and a second front arc member connected to the second front support member;

wherein the first front arc member and the second front arc member are connected to each other;

wherein the folding shade further comprises:

a first front support-arc pivot pivotally connecting the first front arc member with the first front support member;

a second front support-arc pivot pivotally connecting the second front arc member with the second front support member; and a front arc-arc pivot pivotally connecting the first front arc member with the second front arc member;

wherein the front arc-arc pivot allows folding from an unfolded position to a folded position, or unfolding from the folded position to the unfolded position, to occur in a bi-fold action.

2. The folding shade according to claim 1, further comprising an assembly linkage pivotally connected to the front assembly and rear assembly.

3. The folding shade according to claim 1, wherein the front arc-arc pivot allows folding from an unfolded position to a folded position, or unfolding from the folded position to the unfolded position, to occur substantially in a plane that the first front arc member and the second front arc member are arranged in.

4. The folding shade according to claim 1, wherein the rear assembly comprises:

a first rear support member;

a first rear arc member connected to the first rear support member;

a second rear support member; and a second rear arc member connected to the second rear support member;

wherein the first rear arc member and the second rear arc member are connected to each other.

5. The folding shade according to claim 4, further comprising:

a first rear support-arc pivot pivotally connecting the first rear arc member with the first rear support member;

a second rear support-arc pivot pivotally connecting the second rear arc member with the second rear support member; and a rear arc-arc pivot pivotally connecting the first rear arc member with the second rear arc member.

6. The folding shade according to claim 5, wherein the rear arc-arc pivot allows folding from the unfolded position to the folded position, or unfolding from the folded position to the unfolded position, to occur in substantially a plane that the first rear arc member and the second rear arc member are arranged in.

7. The folding shade according to claim 5, wherein the rear arc-arc pivot allows folding from an unfolded position to a folded position, or unfolding from the folded position to the unfolded position, to occur in a bi-fold action.

8. The folding shade according to claim 1, wherein the first hub and the second hub are configured such that rotation at the first hub and the second hub permits mutual movement between the front assembly and the rear assembly.

9. The folding shade according to claim 1, wherein the first mounting portion and the second mounting portion are configured to attach to the folding furniture such that the first mounting portion and the second mounting portion are permanently affixed to the folding furniture.

10. The folding shade according to claim 1, wherein the first mounting portion and the second mounting portion are configured to be removably attached to the folding furniture.

11. A folding shade for use with a collapsible article of furniture comprising:

a folding frame including a first hub, a second hub, a front assembly rotatably connected to the first hub and second hub, a rear assembly rotatably connected to the first hub and second hub;

a shade membrane connected to the front assembly and the rear assembly; and an assembly linkage pivotally connected to the front assembly and rear assembly;

wherein the front assembly comprises:

a first front support member;

a first front arc member pivotally connected to the first front support member via a first front support-arc pivot;

a second front support member; and a second front arc member pivotally connected to the second front support member via a second front support-arc pivot;

wherein the first front arc member and the second front arc member are pivotally connected to each other via an arc-arc pivot;

wherein the rear assembly comprises:

a first rear support member;

a first rear arc member pivotally connected to the first rear support member via a first rear support-arc pivot;

a second rear support member; and a second rear arc member pivotally connected to the second rear support member via a second rear support-arc pivot;

wherein the first rear arc member and the second rear arc member are pivotally connected to each other via an arc-arc pivot;

wherein the first hub includes a first mounting portion and the second hub includes a second mounting portion, and wherein the first mounting portion and the second mounting portion are configured to attach to a folding furniture, and wherein the first hub further includes a first rotating portion and the second hub includes a second rotating portion, and wherein the first rotating portion and the second rotating portion are configured to rotate to and through a plurality of stops.

12. The folding shade according to claim 1, wherein the first hub includes a first rotating portion and the second hub includes a second rotating portion, and wherein the first rotating portion and the second rotating portion are configured to rotate to and through a plurality of stops.

* * * * *